US011629441B2

(12) United States Patent
Masuda et al.

(10) Patent No.: US 11,629,441 B2
(45) Date of Patent: Apr. 18, 2023

(54) CELLULOSE NONWOVEN FABRIC HAVING COMPACTED PARTS

(71) Applicant: Asahi Kasei Kabushiki Kaisha, Tokyo (JP)

(72) Inventors: Chihiro Masuda, Tokyo (JP); Takayuki Ogawa, Tokyo (JP); Shinichi Okajima, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 784 days.

(21) Appl. No.: 16/494,416

(22) PCT Filed: Mar. 28, 2018

(86) PCT No.: PCT/JP2018/012950
§ 371 (c)(1),
(2) Date: Sep. 16, 2019

(87) PCT Pub. No.: WO2018/186269
PCT Pub. Date: Oct. 11, 2018

(65) Prior Publication Data

US 2021/0115604 A1 Apr. 22, 2021

(30) Foreign Application Priority Data

Apr. 7, 2017 (JP) ..... JP2017-077065

(51) Int. Cl.

| | |
|---|---|
| ***D04H 1/425*** | (2012.01) |
| ***D04H 1/4258*** | (2012.01) |
| ***D04H 3/013*** | (2012.01) |
| ***D06C 23/04*** | (2006.01) |
| ***D21H 13/08*** | (2006.01) |

(52) U.S. Cl.
CPC ..... *D04H 1/4258* (2013.01); *D04H 3/013* (2013.01); *D06C 23/04* (2013.01); *D21H 13/08* (2013.01); *Y10T 428/24479* (2015.01)

(58) Field of Classification Search
CPC ..... D04H 1/4258
See application file for complete search history.

(56) References Cited

U.S. PATENT DOCUMENTS

| | | | |
|---|---|---|---|
| 2011/0152795 | A1 | 6/2011 | Aledo et al. |
| 2015/0125499 | A1 | 5/2015 | Ochiai et al. |

FOREIGN PATENT DOCUMENTS

| | | | |
|---|---|---|---|
| CN | 102100640 | A | 6/2011 |
| CN | 104487629 | A | 4/2015 |
| CN | 205115777 | U | 3/2016 |
| CN | 205711402 | U | 11/2016 |
| CN | 106283391 | A | 1/2017 |
| JP | H08-176944 | A | 7/1996 |
| JP | 2003-164405 | A | 6/2003 |
| JP | 2003-292421 | A | 10/2003 |
| JP | 2004-313552 | A | 11/2004 |
| JP | 2005-146451 | A | 6/2005 |
| JP | 2005-211176 | A | 8/2005 |
| JP | 2006-124846 | A | 5/2006 |
| JP | 2006-241625 | A | 9/2006 |
| JP | 2007-307729 | A | 11/2007 |
| JP | 3141945 | U | 5/2008 |
| JP | 2009-155733 | A | 7/2009 |
| JP | 2013-133579 | A | 7/2013 |
| JP | 2016-191160 | A | 11/2016 |

OTHER PUBLICATIONS

International Search Report issued in corresponding International Patent Application No. PCT/JP2018/012950 dated Jun. 5, 2018.
International Preliminary Report on Patentability and Written Opinion issued in corresponding International Patent Application No. PCT/JP2018/012950 dated Oct. 17, 2019.
Supplementary European Search Report issued in corresponding European Patent Application No. 18781737.4 dated Mar. 12, 2020.

*Primary Examiner* — William P Watkins, III
(74) *Attorney, Agent, or Firm* — Morgan, Lewis & Bockius LLP

(57) ABSTRACT

Provided is a cellulose fiber nonwoven fabric with compacted parts that is beautiful even when dry. The cellulose fiber nonwoven fabric is characterized in that: the fabric has compacted parts; the percentage of recesses due to the compacting is 9-25%; the transverse rupture strength is at least 15 N; the transmittance of the compacted parts when dry is 3-25%; and the fabric weight is 30 g/m$^2$ to 110 g/m$^2$.

8 Claims, No Drawings

CELLULOSE NONWOVEN FABRIC HAVING COMPACTED PARTS

FIELD

The present invention relates to a cellulose fiber nonwoven fabric in which compacted parts are able to maintain transparency when dry.

BACKGROUND

As a technique for imparting designability to a nonwoven fabric, patterning by heat embossing is widely employed. Specifically, for thermoplastic fibers such as nylon, polypropylene, polyethylene, etc., heat embossing is frequently carried out to retain the shape of the nonwoven fabric or adjust the strength thereof by fusing the fibers together and imparting designability. However, in non-thermoplastic fibers such as cellulose fibers, the fibers do not fuse even after patterning by heat embossing, and thus maintaining designability is difficult.

Therefore, as described in PTL 1 below, the technique of adding multiple recesses to the surface of the nonwoven fabric by embossing, so as to increase the impregnation amount of humectants, is known. However, the shapes of the added recesses are preferably geometric shapes such as ovals, squares, triangles, and circles, such that there is little freedom of the pattern and imparting a design with superior appearance is difficult.

In addition to the above method, PTL 2 below describes a nonwoven fabric, wherein multiple dry-type air-laid nonwoven fabric layers are laminated and heat fusion is performed between the air-laid nonwoven fabrics with each other via heat embossing, resulting in improved strength whether wet or dry, and translucency of the heat embossed part when wet. However, since the air-laid nonwoven fabrics are heat fused together by heat embossing, there is the problem that rigidity of the nonwoven fabric increases, and suitable flexibility may be lost. Additionally, the heat embossed part would become translucent when wet, but remained the same white color as the unprocessed part when dry, such that imparting designability when dry is difficult.

PTL 3 below describes a wet sheet for cleaning, comprising an inner layer which is capable of being impregnated with and retaining an aqueous detergent and which is infused with hydrophilic fibers arranged on both sides of the inner layer by heat embossing, etc. However, since it is a wet sheet for cleaning, it has a higher fabric weight and an increased thickness to increase wiping efficiency, such that the heat embossed portion is opaque when dry and it is difficult to impart designability with superior appearance.

CITATION LIST

Patent Literature

[PTL 1] Japanese Unexamined Patent Application (Kokai) No. 2003-292421

[PTL 2] Japanese Unexamined Patent Application (Kokai) No. 2006-241625

[PTL 3] Japanese Unexamined Patent Application (Kokai) No. 2004-313552

SUMMARY

Technical Problem

In light of the aforementioned problems of prior art, the object of the present invention is to provide a nonwoven fabric having compacted parts with superior appearance when dry.

As a result of keen evaluation and repeated experiments to achieve the above object, the present inventors discovered that when a cellulose fiber nonwoven fabric has compacted parts and non-compacted parts, a percentage of recesses due to compacting is 9 to 25%, a transverse rupture strength of the fabric is at least 15 N, and a basis weight of the fabric is 30 g/m$^2$ to 110 g/m$^2$, the transmittance of the compacted parts when dry is 3 to 25% such that there is also high transmittance even when dry, thereby obtaining designability, and have completed the present invention.

Thus, the present invention is as follows.

[1] A cellulose fiber nonwoven fabric having compacted parts and non-compacted parts, wherein a percentage of recesses due to compacting is 9 to 25%, a transverse rupture strength of the fabric is at least 15 N, a transmittance of the compacted parts when dry is 3 to 25%, and a basis weight of the fabric is 30 g/m$^2$ to 110 g/m$^2$.

[2] The cellulose fiber nonwoven fabric according to [1], wherein a transmittance of the compacted parts when wet is at least 4%.

[3] The cellulose fiber nonwoven fabric according to [1] or [2], wherein a transmittance of the non-compacted parts when dry is 1 to 4%, and a transmittance of the non-compacted parts when wet is 1 to 30%.

[4] The cellulose fiber nonwoven fabric according to any one of [1] to [3], wherein a transmittance difference between the compacted parts and the non-compacted parts when dry is at least 2, and a transmittance difference between the compacted parts and the non-compacted parts when wet is not greater than 35. [5] The cellulose fiber nonwoven fabric according to any one of [1] to [4], wherein the cellulose fiber nonwoven fabric does not comprise a binder.

[6] The cellulose fiber nonwoven fabric according to any one of [1] to [5], comprising 50 to 100 parts by weight of cellulose fiber, and 0 to 50 parts by weight of other fibers.

[7] The cellulose fiber nonwoven fabric according to any one of [1] to [6], wherein compacted parts are formed by heat embossing.

[8] The cellulose fiber nonwoven fabric according to any one of [1] to [7], wherein a texture index of the nonwoven fabric when dry is not greater than 400.

[9] The cellulose fiber nonwoven fabric according to any one of [1] to [8], wherein a percent of area of the compacted parts in the transverse direction is 2 to 10%.

The cellulose fiber nonwoven fabric of the present invention demonstrates high designability since the fabric has compacted parts with cellulose fibers densely compacted, and the compacted parts have high transmittance when dry. Additionally, the cellulose fiber fabric has an indicator function such that the wetness of the cellulose fiber nonwoven fabric can be visually confirmed with the difference in transmittance compared to that when wet.

DESCRIPTION OF EMBODIMENTS

The embodiments of the present invention will be explained in detail below.

As the cellulose fiber constituting the nonwoven fabric of the present embodiment, regenerated cellulose fiber such as cuprammonium rayon, viscose rayon, tencel (lyocell), or polynosic; cotton, pulp, or natural cellulose fiber such as hemp is used. Preferably regenerated cellulose fiber, or most preferably, cuprammonium rayon or tencel (lyocell) is used. Most preferable is cuprammonium rayon, which has many amorphous regions within the fiber, and compacted parts which easily become transparent as compared with other cellulose fibers. The fibers can be either long continuous fibers or short fibers, but long continuous fibers have superior lint-free characteristics, superior liquid absorption, and good surface smoothness, as compared to short fibers, and are thus preferably used. There is concern that cellulose fiber nonwoven fabric sheets to which a binder or a surfactant has been imparted have decreased water absorption and leakage of binder, so a cellulose fiber nonwoven fabric with no binder is preferable. Additionally, regarding the configuration form of the nonwoven fabric, a single-layer construction of only cellulose fiber nonwoven fabric is acceptable, as are a laminated structure combining a fiber nonwoven fabric other than a cellulose fiber nonwoven fabric with a cellulose fiber nonwoven fabric, a nonwoven fabric structure of blended fibers of short cellulose fibers and short fibers composed of another material, as will be discussed later, and other structures of fiber nonwoven fabrics. The general fiber diameter of the cellulose fibers constituting the nonwoven fabric is 0.5 to 30 μm, and the general fiber diameter of the other fibers is 1 to 20 μm. These fiber diameters are just common examples, and do not limit the diameters of the fibers.

In the present specification, the term "cellulose fiber nonwoven fabric" encompasses, in addition to the cellulose fibers above, fibers which include a portion of fibers other than cellulose, such as synthetic fibers like polyester fibers, polypropylene fibers, nylon fibers, polyamide fibers, polyolefin fibers, or other materials. The composition of the fibers in the nonwoven fabric is preferably 50 to 100 parts by weight of cellulose fibers and 0 to 50 parts by weight of other fibers, more preferably 60 to 100 parts by weight of cellulose fibers and 0 to 40 parts by weight of other fibers, and most preferably, 70 to 100 parts by weight of cellulose fibers and 0 to 30 parts by weight of other fibers. If less than 50 parts by weight of cellulose fibers are included, the compositional ratio of other fibers increases, whereby transmittance when wet decreases, appearance degrades, and the fabric is not suitable.

As a method for providing compacted parts to a cellulose fiber nonwoven fabric above, heat embossing is suitable. In heat embossing, an embossing roller with protrusions contacts the cellulose fiber nonwoven fabric, and by pressing into the surface, the shape of the embossing roller form is applied to the cellulose fiber nonwoven fabric sheet as a pattern. The heat embossing device may be a combination of a smooth roller and an embossing roller having protrusions or a pair of embossing rollers. Additionally, regarding the combination of rollers for performing heat embossing, any combination of rubber rollers, ceramic rollers, and metal rollers enable good transcription of the pattern. These preferable aspects are examples; compacting by other processing methods is acceptable.

In the present specification, the term "compacted part" refers to the state in which the compacted part has been densely compacted to at least 1.1 times of the fibers of the nonwoven fabric of the substrate and, when dry, has a difference from the substrate (in surface roughness or light dispersion) which can be confirmed visually. The other parts are referred to as "non-compacted parts".

The percentage of recesses for achieving the transmittance of the cellulose fiber nonwoven fabric of the present embodiment when dry is preferably 9 to 25%, more preferably 10 to 23%, even more preferably 15 to 20%, and most preferably 15 to 25%. If the percentage of recesses is below 9%, the compacted parts are too thin, such that problems like, for example, when using the nonwoven fabric, shear forces would accumulate in the compacted parts, resulting in rips, etc., arise, and the range is unsuitable. Conversely, if the percentage of recesses exceeds 25%, the transmittance when dry decreases, whereby designability with superior appearance cannot be achieved, and the range is unsuitable.

In the present specification, the term "dry" refers to the state when the fabric has been left in a constant temperature chamber at 20° C., 65% RH for at least 16 hours.

The transmittance of the compacted parts when dry as indicated above is 3 to 25%, preferably 3 to 20%, and more preferably 4 to 17%. If the transmittance of the compacted parts when dry is less than 3%, there is no difference in color compared to the non-compacted parts, such that designability with superior appearance when dry cannot be achieved, and the range is unsuitable. Conversely, when the transmittance when dry exceeds 25%, the transmittance when wet also increases, whereby the pattern becomes too stark, and the range is unsuitable.

The transmittance of the compacted parts when wet is preferably at least 4%, more preferably at least 6%, even more preferably at least 10%, even more preferably at least 12%, and most preferably at least 14%. If the transmittance when wet is less than 4%, the pattern lacks clarity, whereby designability cannot be achieved, and the range is unsuitable. The upper limit for the transmittance of the compacted parts when wet can be set as appropriate, but if it is set as not greater than 70%, for example, proper designability for use in contact with the face, such as in beauty packs, can be preferably achieved, though not greater than 60% is more preferable, and not greater than 50% is most preferable.

As a method for adjusting the transmittance of the compacted parts, changing the degree of crystallinity of the raw material to adjust the state of the compacted parts is possible. For example, by selecting cupra, a material with a lower degree of crystallinity than similar regenerated cellulose fibers, the transmittance of the compacted parts can be decreased below that of viscose or lyocell. Additionally, for example, the transmittance of the compacted parts can be made high by increasing the temperature of the roller or increasing the nip pressure in the processing (heat embossing) of the compacted parts. The above adjustment of transmittance of the compacted parts is an example, and does not limit the materials and processing methods that can be used.

The transmittance of the non-compacted parts when dry is preferably 1 to 7%, and more preferably 1 to 6%. Additionally, the transmittance of the non-compacted parts when wet is preferably 1 to 30%, more preferably 2 to 26%, even more preferably 4 to 22%, even more preferably 4 to 16%, and most preferably 4 to 10%. If the transmittance of the non-compacted parts when dry is less than 1%, the contrast with the compacted parts is too high, whereby appearance degrades, and the range is unsuitable. Conversely, if the transmittance of the non-compacted parts when dry exceeds 7%, the contrast with the compacted parts is too low, whereby superior appearance cannot be achieved, and the range is unsuitable. Additionally, if the transmittance of the non-compacted parts when wet is less than 1%, the contrast with the compacted parts is too high, whereby appearance degrades, and the range is unsuitable. Conversely, if the transmittance of the non-compacted parts when wet exceeds 30%, the contrast with the compacted parts is too low, whereby superior appearance cannot be achieved, and the range is unsuitable.

In the present specification, "wet" refers to the state in which a humectant (for example, water, or cosmetic liquid) is applied in an amount above the moisture retention demonstrated by the cellulose fiber nonwoven fabric in a moisture retention test described later.

The transmittance difference between the compacted parts and the non-compacted parts of the cellulose fiber nonwoven fabric of the present embodiment when dry (hereinafter referred to simply as "dry transmittance difference") is preferably at least 2, and the transmittance difference between the compacted parts and the non-compacted parts when wet (hereinafter referred to simply as "wet transmittance difference") is preferably not greater than 35. If the dry transmittance difference is less than 2, the contrast between the compacted parts and the non-compacted parts is low, whereby visibility of the pattern decreases, designability with superior appearance cannot be achieved, and the range is unsuitable. If the wet transmittance difference exceeds 35, the contrast between the compacted parts and the non-compacted parts is high, and visibility increases remarkably, such that, for example, the pattern may appear too clearly for use as a beauty pack such that the user does not feel sufficiently satisfied, and the range is unsuitable.

In the present specification, "dry transmittance difference" and "wet transmittance difference" are dimensionless values obtained by the following formulas.

"dry transmittance difference"="transmittance of compacted parts when dry"−"transmittance of non-compacted parts when dry"

"wet transmittance difference"="transmittance of compacted parts when wet"−"transmittance of non-compacted parts when wet"

The transverse rupture strength of the cellulose fiber nonwoven fabric of the present embodiment is at least 15 N (Newtons), preferably at least 18 N, more preferably at least 20 N. If the transverse rupture strength is less than 15 N, for example, the nonwoven fabric may rip when a user attempts to put the nonwoven fabric on their face as a beauty pack, or handling is poor when the nonwoven fabric is spread out because the nonwoven fabric has a weak elasticity, and the range is unsuitable. Additionally, when post-processing the nonwoven fabric for dry slits, etc., the fabric cannot withstand processing tension, and rips, and the range is unsuitable.

An upper limit for transverse rupture strength of the cellulose fiber nonwoven fabric can be appropriately set as a matter of design choice, but an upper limit is preferably set as not greater than 80 N, whereby handling and processability during post-processing can be obtained, and wearer satisfaction can be achieved if the fabric is used as a beauty pack, or more preferably, not greater than 60 N, and even more preferably, not greater than 50 N.

The basis weight (fabric weight) of the cellulose fiber nonwoven fabric of the present embodiment is preferably 30 to 110 g/m$^2$, more preferably 30 to 85 g/m$^2$, and even more preferably 65 g/m$^2$.

If the fabric weight of the cellulose fiber nonwoven fabric is less than 30 g/m$^2$, the sheet is thin, and fiber density is low, such that transmittance rises for the whole of the nonwoven fabric, the difference in transmittance with the compacted parts is low, and clear designability cannot be achieved. Additionally, even if there is a pattern, the pattern becomes less prominent with the passage of time and friction, which is not preferable. Conversely, if the fabric weight of the cellulose fiber nonwoven fabric sheet exceeds 110 g/m$^2$, the sheet is thick, and fiber density rises, whereby the transmittance when dry decreases, and the range is unsuitable. Additionally, increasing the percentage of recesses to achieve transmittance makes the composition state of the fiber surface worse, and unfavorably degrades handling and feel.

The texture index when dry of the cellulose fiber nonwoven fabric is preferably not greater than 400, more preferably, the texture index when dry is not greater than 300, even more preferably, the texture index when dry is not greater than 250. If the texture index exceeds 400, the compression of fibers due to compacting is inconsistent, and spots of unevenness in transmittance when dry appear, such that designability is substantially lost and the range is unsuitable.

The percent of the area of the compacted parts in the width (traverse) direction of the cellulose nonwoven fabric of the present embodiment is preferably 2 to 10%, more preferably 2 to 8%, and most preferably 2 to 6%. If the percent of the area of the compacted parts is less than 2%, the percent of the area is too small, whereby suitable designability cannot be achieved, and the range is unsuitable. Conversely, if the percent of area of the compacted parts exceeds 10%, for example, the feeling of attachment when attaching to the face as a beauty pack is decreased, and the range is unsuitable.

EXAMPLES

The following Examples and Comparative Examples provide a more detailed explanation of the present invention, but the present invention is not limited by the Examples. First, the test method for each of the measurement items in the Examples will be explained.

[Basis Weight (Fabric Weight)]

The basis weight (g) per m$^2$ of the nonwoven fabric (fabric weight) was determined by drying a cellulose fiber nonwoven fabric sheet with an area of at least 0.05 m$^2$ until it reached a constant weight, which was then left in a constant temperature chamber at 20° C., 65% RH for at least 16 hours, and then weighed. Unless specified otherwise, each of the following measurements used a cellulose fiber nonwoven fabric prepared in these conditions.

[Compacting]

The cellulose fiber nonwoven fabric was cut to an arbitrary size, which was then cut so as to form a compacted parts and a non-compacted part of approximately equal size, and then fabric weight was measured with N=5. The average value was taken as fabric weight. Additionally, the thickness of each part was measured according to the cross-sectional image of an electron scanning microscope (VE-880, Keyence Corp.), and the average value was taken as thickness. It was determined that a part was compacted if the part satisfied the following equation and was visually distinguishable.

$$A \times D/C \times B \geq 1.1$$

wherein A is the fabric weight of the compacted part (g), B is the thickness of the compacted part (mm), C is the fabric weight of the non-compacted part (g), and D is the thickness of the non-compacted part (mm).

[Percentage of Recesses]

With the compacted parts B (mm) and the non-compacted parts D (mm), the percentage of recesses E (%) is defined as:

$$E=B/D\times 100$$

[Transmittance when Dry]

The cellulose fiber nonwoven fabric was cut to a size of 15 mm×80 mm (the compacted parts and non-compacted parts alternating along the longitudinal direction), and inserted into a glass tube as a sample. Then, a solution stability evaluation system (Turbiscan MA 2000, Eko Instruments Co., Ltd.) was attached such that the surface of the sample in the glass tube was vertical relative to the light source of the solution stability evaluation system. Thereafter, the sample was scanned with infrared light having a wavelength of 850 nm at 40 μm increments from the light source, and the sample transmittance was measured with N=5. The average value (N=5) of maximum transmittance of the compacted parts and the non-compacted parts of the nonwoven fabric at scanning positions in intervals of 10 to 50 mm was taken as the transmittance when dry.

[Transmittance when Wet]

The cellulose fiber nonwoven fabric was cut to a size of 15 mm×80 mm (the compacted parts and non-compacted parts alternating along the longitudinal direction), and inserted into a glass tube as a sample. Then, the interior of the glass tube was filled with distilled water. Thereafter, the transmittances of the compacted parts and non-compacted parts when wet were measured using a method similar to the above measurement of transmittance when dry.

[Texture Index when Dry]

The cellulose fiber nonwoven fabric was cut to a size of 20 cm×20 cm, and the texture index was measured using a texture meter (FMT-M III, Nomura Shoji Co., Ltd.). The smaller the value of the texture index, the better the distribution of fibers in the nonwoven fabric, and the fewer spots of unevenness. Conversely, the larger the value of the texture index, the worse the distribution of fibers, and the more spots of unevenness.

[Percent of Area (%) (of Compacted Parts)]

Using a digital camera, a 10 mm×300 mm cellulose fiber nonwoven fabric sheet was photographed from a height of 20 cm. Then, the image data was imported into a computer, and then output as a binarized image. At that time, a color difference between the compacted parts and the non-compacted parts appeared on the cellulose fiber nonwoven fabric sheet, and therefore, the area ratio of the color difference was taken as is as the area ratio in the cellulose fiber nonwoven fabric sheet, and the average value of values measured with N=5 was defined as the area ratio. If the compacted parts area is taken as F ($mm^2$) and the non-compacted parts area is taken as G ($mm^2$), the percent of area (%) is defined by the following formula:

$$H=F/G\times 100$$

[Designability when Dry]

10 randomly chosen participants evaluated whether the designability of the cellulose fiber nonwoven fabric could be visually distinguished. Then, an evaluation of "Excellent" was assigned if the compacted parts had high transparency and good designability, "Good" if they could distinguish the compacted parts, "Poor" if the compacted parts were semi-transparent and designability was hard to confirm, and "Bad" if the compacted parts were white and designability could not be confirmed.

[Transverse Rupture Strength]

A test piece of cellulose fiber nonwoven fabric with a width of 5 cm and a length of 15 cm was held along a holding length of 10 cm, and then stretched using a constant speed extension-type tensile tester (Tensilon UCT-lt, Orientec) with a stretching speed of 30 cm±3 cm/min in the direction that the nonwoven fabric has extensibility, and the pulling strength when the test piece broke was measured with N=5. The average value of the values obtained was taken as transverse rupture strength. The sample was taken such that the longitudinal direction of the test piece was the longitudinal direction of the nonwoven fabric.

Example 1

A cellulose long fiber nonwoven fabric (fabric weight: 59.6 g/$m^2$, cupra) with cotton linter as a raw material was used as the original fabric. Using a heat embossing device, the fabric was processed such that the percentage of recesses of the compacted parts was 20.0% and the percent of area was 3.1%, and a cellulose fiber nonwoven fabric was obtained. The obtained nonwoven fabric was evaluated using each test and measurement described above. The results are shown in Table 1 below. The cellulose fiber nonwoven fabric had transmittance when dry of 14.7%, and good designability was obtained.

Example 2

A cellulose long fiber nonwoven fabric (cupra) with a fabric weight of 30.1 g/$m^2$ underwent similar processing as Example 1, except that the percentage of recesses of the compacted parts was 15.1%, and the percent of area was 2.3%, and was then evaluated. The results are shown in Table 1 below.

Example 3

A cellulose short fiber nonwoven fabric (cotton) with a fabric weight of 61.1 g/$m^2$ underwent similar processing as Example 1, except that the percentage of recesses of the compacted parts was 24.9%, and the percent of area was 3.4%, and was then evaluated. The results are shown in Table 1 below.

Example 4

A cellulose short fiber nonwoven fabric (rayon) with a fabric weight of 63.5 g/$m^2$ underwent similar processing as Example 1, except that the percentage of recesses of the compacted parts was 24.8%, and the percent of area was 3.8%, and was then evaluated. The results are shown in Table 1 below.

Example 5

A cellulose short fiber nonwoven fabric (cupra) with a fabric weight of 74.5 g/$m^2$ underwent similar processing as Example 1, except that the percentage of recesses of the compacted parts was 24.9%, and the percent of area was 8.9%, and was then evaluated. The results are shown in Table 1 below.

Example 6

A cellulose long fiber nonwoven fabric composed of 70 parts by weight of cupra (short fibers, staples) and 30 parts by weight of polypropylene (short fibers) with a fabric weight of 72.4 g/m$^2$ underwent similar processing as Example 1, except that the percentage of recesses of the compacted parts was 25.0%, and the percent of area was 9.2%, and was then evaluated. The results are shown in Table 1 below.

Example 7

A cellulose short fiber nonwoven fabric (lyocell) with a fabric weight of 34.8 g/m$^2$ underwent similar processing as Example 1, except that the percentage of recesses of the compacted parts was 15.3%, and the percent of area was 2.8%, and was then evaluated. The results are shown in Table 1 below.

Example 8

A three layer nonwoven fabric with a fabric weight of 105.0 g/m$^2$ was obtained by interposing a polypropylene long fiber nonwoven fabric between two layers of cellulose long fiber nonwoven fabric (cupra) and then heat embossing. The fabric underwent similar processing as Example 1, except that the percentage of recesses of the compacted parts was 25.0%, and the percent of area was 2.2%, and was then evaluated. The results are shown in Table 1 below.

Example 9

A two layer nonwoven fabric with a fabric weight of 50.1 g/m$^2$ was obtained by bonding a cellulose long fiber nonwoven fabric (cupra) and a nylon long fiber nonwoven fabric by heat embossing. The fabric underwent similar processing as Example 1, except that the percentage of recesses of the compacted parts was 20.2%, and the percent of area was 3.6%, and was then evaluated. The results are shown in Table 1 below.

Comparative Example 1

A cellulose fiber nonwoven fabric (cupra) with a fabric weight of 59.6 g/m$^2$ underwent similar processing as Example 1, except that the percentage of recesses of the compacted parts was 14.6% and the percent of area was 3.1%, and was then evaluated. The results are shown in Table 2 below. Since the percentage of recesses was low, the transmittance when dry was good, but contact with the protrusions of the embossing roller becomes stronger, causing pinhole-shaped rips in the original fabric, and therefore the fabric was not suitable for use.

Comparative Example 2

The same cellulose fiber nonwoven fabric as Comparative Example 1 underwent similar processing as Example 1, except that the percentage of recesses of the compacted parts was 25.3% and the percent of area was 3.1%, and was then evaluated. The results are shown in Table 2 below. The percentage of recesses was low, such that degeneration of the transparency of the compacted parts did not proceed sufficiently, and sufficient designability was not obtained.

Comparative Example 3

A cellulose fiber nonwoven fabric (cupra) with a fabric weight of 28.3 g/m$^2$ underwent similar processing as Example 1, except that the percentage of recesses of the compacted parts was 15.1% and the percent of area was 4.2%, and was then evaluated. The results are shown in Table 2 below. The transmittance of the compacted parts was good, but the weight was light, such that it was hard to distinguish from the non-compacted parts, and good designability was not obtained.

Comparative Example 4

A cellulose fiber nonwoven fabric (rayon) with a weight of 120 g/m$^2$ underwent similar processing as Example 1, except that the percentage of recesses of the compacted parts was 24.6% and the percent of area was 8.2%, and was then evaluated. The results are shown in Table 2 below. The fabric weight was thick, and fiber density was high, such that good designability was not obtained.

Comparative Example 5

A cellulose fiber nonwoven fabric (cotton) with a fabric weight of 25.6 g/m$^2$ underwent similar processing as Example 1, except that the percentage of recesses of the compacted parts was 17.1% and the percent of area was 7.8%, and was then evaluated. The results are shown in Table 2 below. The texture index was large, and the fiber dispersion was poor, such that the fibers in the compacted parts were not compressed uniformly, and good designability was not obtained.

Comparative Example 6

A cellulose fiber nonwoven fabric composed of 30 parts by weight of cupra and 70 parts by weight of polypropylene with a fabric weight of 73.2 g/m$^2$ underwent similar processing as Example 1, except that the percentage of recesses of the compacted parts was 17.1% and the percent of area was 8.4%, and was then evaluated. The results are shown in Table 2 below. Since the composition ratio in the nonwoven fabric was higher for other fibers than for the cellulose fibers, a change in the transparency of the compacted parts did not occur, and good designability was not obtained.

Comparative Example 7

A cellulose fiber nonwoven fabric (lyocell) with a fabric weight of 34.8 g/m$^2$ underwent similar processing as Example 1, except that the percentage of recesses of the compacted parts was 15.3% and the percent of area was 1.9%, and was then evaluated. The results are shown in Table 2 below. The percent of area of the compacted parts was small, such that the fibers in the nonwoven fabric received strong compressive stress, and pinhole-shaped rips occurred in the compacted parts, and therefore the fabric was not suitable for use.

Comparative Example 8

A cellulose fiber nonwoven fabric (cupra) having a fabric weight of 59.6 g/m$^2$ underwent similar processing as Example 1, except that the percentage of recesses of the compacted parts was 14.3% and the percent of area was 4.1%, and then evaluated. The results are shown in Table 2 below.

The strength of the fabric was measured to be 13.2 [N]. The fabric was formed into a face mask. The face mask tore along the compacted parts when worn, and was not suitable for use.

TABLE 1

| Item | | Example 1 | Example 2 | Example 3 | Example 4 | Example 5 | Example 6 | Example 7 | Example 8 | Example 9 |
|---|---|---|---|---|---|---|---|---|---|---|
| Basis weight [g/m$^2$] | | 59.6 | 30.1 | 61.1 | 63.5 | 74.5 | 72.4 | 34.8 | 105.0 | 50.1 |
| Rate of recesses [%] | | 20.0 | 15.1 | 24.9 | 24.8 | 24.9 | 25.0 | 15.3 | 25.0 | 20.2 |
| Transmittance of compacted parts (dry) [%] | | 14.7 | 18.1 | 4.4 | 5.0 | 4.9 | 3.5 | 18.4 | 6.3 | 5.3 |
| Transmittance of compacted parts (wet) [%] | | 14.0 | 18.4 | 6.7 | 5.9 | 7.4 | 4.2 | 11.8 | 34.3 | 32.7 |
| Transmittance difference (dry) | | 11.6 | 12.3 | 2.0 | 2.6 | 2.2 | 2.2 | 12.5 | 4.0 | 5.1 |
| Transmittance difference (wet) | | 6.3 | 6.1 | 5.4 | 4.4 | 1.2 | 1.8 | 5.6 | 34.8 | 32.3 |
| Transverse rupture strength [N] | | 15.8 | 15.1 | 21.1 | 22.2 | 25.8 | 27.2 | 15.0 | 36.1 | 49.8 |
| Composition ratio | Cellulose fibers | 100 | 100 | 100 | 100 | 100 | 70 | 100 | 72 | 76 |
| | Other fibers | 0 | 0 | 0 | 0 | 0 | 30 | 0 | 28 | 24 |
| Type of fiber | | cupra | cupra | cotton | rayon | cupra | cupra/PP | lyocell | cupra/PP | cupra/Ny |
| Texture index | | 155 | 156 | 186 | 191 | 162 | 174 | 313 | 397 | 365 |
| Percent of area of compacted parts [%] | | 3.1 | 2.3 | 3.4 | 3.8 | 8.9 | 9.2 | 2.8 | 2.2 | 3.6 |
| Designability | | Excellent | Excellent | Good | Good | Excellent | Good | Good | Good | Good |

TABLE 2

| Item | | Comparative example 1 | Comparative example 2 | Comparative example 3 | Comparative example 4 | Comparative example 5 | Comparative example 6 | Comparative example 7 | Comparative example 8 |
|---|---|---|---|---|---|---|---|---|---|
| Basis weight [g/m$^2$] | | 59.6 | 59.6 | 28.3 | 120 | 25.6 | 73.2 | 34.8 | 59.6 |
| Rate of recesses [%] | | 14.6 | 25.3 | 15.1 | 24.6 | 17.1 | 17.1 | 15.3 | 14.3 |
| Transmittance of compacted parts (dry) [%] | | 26.0 | 2.8 | 19.9 | 1.1 | 6.2 | 0.9 | 2.8 | 25 |
| Transmittance of compacted parts (wet) [%] | | 76.9 | 11.1 | 23.1 | 49.5 | 10.9 | 3.9 | 3.6 | 30 |
| Transmittance difference (dry) | | 23.9 | 1.2 | 0.4 | 1.8 | 1.6 | 0.3 | 1.9 | 18.6 |
| Transmittance difference (wet) | | 70.2 | 28.2 | 10.3 | 3.1 | 11.8 | 1.4 | 4.4 | 50.1 |
| Transverse rupture strength [N] | | 14.8 | 18.2 | 13.2 | 30.1 | 19 | 32 | 15.3 | 13.2 |
| Composition ratio | Cellulose fibers | 100 | 100 | 100 | 100 | 100 | 30 | 100 | 100 |
| | Other fibers | 0 | 0 | 0 | 0 | 0 | 70 | 0 | 0 |
| Type of fiber | | cupra | cupra | cupra | rayon | cotton | cupra/PP | lyocell | cupra |
| Texture index | | 162 | 157 | 240 | 148 | 445 | 174 | 320 | 182 |
| Percent area of compacted parts [%] | | 3.1 | 3.1 | 4.2 | 8.2 | 7.8 | 8.4 | 1.9 | 4.1 |
| Designability | | Good (rip) | Bad | Poor | Bad | Bad | Bad | Bad | Good |

INDUSTRIAL APPLICABILITY

Since the cellulose fiber nonwoven fabric of the present invention has compacted parts with superior appearance when dry, it is suitably applicable to uses such as in beauty face mask sheets, antiperspirant nonwoven fabric sheets, alcohol wet wipes, other wet wipes for make-up removal, etc., uses in the cosmetics field as cosmetic bulk or as alcohol-laden base materials, use in electronic materials, medical use, use in living materials, use in agricultural materials, food-related uses, and use in industrial materials.

The invention claimed is:

1. A cellulose fiber nonwoven fabric having compacted parts and non-compacted parts, wherein a percentage of recesses due to compacting is 9 to 25%, a transverse rupture strength of the fabric is at least 15 N, a transmittance of the compacted parts when dry is 3 to 25%, and a basis weight of the fabric is 30 g/m$^2$ to 110 g/m$^2$, a transmittance difference between the compacted parts and the non-compacted parts when dry is at least 2%, and a transmittance difference between the compacted parts and the non-compacted parts when wet is 35% or lower.

2. The cellulose fiber nonwoven fabric of claim 1, wherein a transmittance of the compacted parts when wet is at least 4%.

3. The cellulose fiber nonwoven fabric of claim 1, wherein a transmittance of the non-compacted parts when dry is 1 to 4%, and a transmittance of the non-compacted parts when wet is 1 to 30%.

4. The cellulose fiber nonwoven fabric of claim 1, wherein the cellulose fiber nonwoven fabric does not comprise a binder.

5. The cellulose fiber nonwoven fabric of claim 1, comprising 50 to 100 parts by weight of cellulose fibers, and 0 to 50 parts by weight of other fibers.

6. The cellulose fiber nonwoven fabric of claim 1, wherein the compacted parts are formed by heat embossing.

7. The cellulose fiber nonwoven fabric of claim 1, wherein the texture index of the nonwoven fabric when dry is not greater than 400.

8. The cellulose fiber nonwoven fabric of claim 1, wherein a percent of the area of the compacted parts in the transverse direction is 2 to 10%.

* * * * *